US009142166B2

(12) United States Patent
Oniki

(10) Patent No.: US 9,142,166 B2
(45) Date of Patent: Sep. 22, 2015

(54) LIQUID CRYSTAL DISPLAY DEVICE AND TV RECEIVER

(75) Inventor: Motoyuki Oniki, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 69 days.

(21) Appl. No.: 13/638,563

(22) PCT Filed: Mar. 30, 2011

(86) PCT No.: PCT/JP2011/058052

§ 371 (c)(1),
(2), (4) Date: Sep. 28, 2012

(87) PCT Pub. No.: WO2011/125755

PCT Pub. Date: Oct. 13, 2011

(65) Prior Publication Data

US 2013/0016140 A1 Jan. 17, 2013

(30) Foreign Application Priority Data

Mar. 31, 2010 (JP) ..... 2010-081067
Mar. 30, 2011 (JP) ..... 2011-074028

(51) Int. Cl.
*G09G 3/36* (2006.01)
*G09G 3/34* (2006.01)

(52) U.S. Cl.
CPC ..... *G09G 3/342* (2013.01); *G09G 2310/0237* (2013.01); *G09G 2360/144* (2013.01)

(58) Field of Classification Search
CPC ..... G09G 3/36; G09G 2330/021; G09G 2330/045; G09G 2320/062; G09G 2320/0626; G09G 2320/066; G09G 2320/02; G09G 2320/021
USPC ..... 345/102, 690, 207
See application file for complete search history.

(56) References Cited

U.S. PATENT DOCUMENTS

| | | | | |
|---|---|---|---|---|
| 7,755,595 | B2 * | 7/2010 | Ferguson | 345/102 |
| 2002/0021292 | A1 | 2/2002 | Sakashita | |
| 2005/0225983 | A1 * | 10/2005 | Fornell | 362/276 |

(Continued)

FOREIGN PATENT DOCUMENTS

| | | | |
|---|---|---|---|
| JP | 10-112396 | A | 4/1998 |
| JP | 2000-112441 | A | 4/2000 |
| JP | 2001-338776 | A | 12/2001 |
| JP | 2002-56996 | A | 2/2002 |
| JP | 2004-157373 | A | 6/2004 |

(Continued)

*Primary Examiner* — Jennifer Nguyen
(74) *Attorney, Agent, or Firm* — Birch, Stewart, Kolasch & Birch, LLP

(57) ABSTRACT

Provided is a liquid crystal display device capable of improving motion blur and preventing excessive current flow into a light source with a desired balance in a structure where the light intensity of a backlight device is properly changed in conjunction with the ambient illuminance. If the ambient illuminance (S1) of a liquid crystal display device is lower than a preliminarily set predetermined illuminance, a backlight scanning process (intermittent lighting process) is implemented (Yes of S2, S3), while if the ambient illuminance is not lower than the predetermined illuminance, the backlight scanning process (intermittent lighting process) is terminated (No of S2, S21). The light intensity of the backlight device is changed in conjunction with the high and low ambient illuminance by changing the drive current supplied to the light source, depending on the ambient illuminance of the liquid crystal display device and whether or not to implement the backlight scanning process (intermittent lighting process) (S4, S22).

20 Claims, 5 Drawing Sheets

(56) References Cited

U.S. PATENT DOCUMENTS

| | | | | |
|---|---|---|---|---|
| 2005/0259064 | A1* | 11/2005 | Sugino et al. | 345/102 |
| 2006/0007219 | A1 | 1/2006 | Sakashita | |
| 2006/0125742 | A1 | 6/2006 | Sekiguchi et al. | |
| 2006/0192748 | A1 | 8/2006 | Lowles et al. | |
| 2008/0198181 | A1 | 8/2008 | Kondo et al. | |
| 2009/0243995 | A1* | 10/2009 | Kimura | 345/102 |

FOREIGN PATENT DOCUMENTS

| | | | |
|---|---|---|---|
| JP | 2004-294921 | A | 10/2004 |
| JP | 2006-178435 | A | 7/2006 |
| JP | 2007-148444 | A | 6/2007 |
| JP | 2007-164202 | A | 6/2007 |
| JP | 2008-203647 | A | 9/2008 |
| JP | 2009-229512 | A | 10/2009 |

* cited by examiner

FIG.4

| AMBIENT ILLUMINANCE | LUMINOUS INTENSITY OF BACKLIGHT DEVICE | BACKLIGHT SCANNING | DRIVE CURRENT |
|---|---|---|---|
| 400[lx] | 450[cd] | OFF | 100MA |
| | | ON | 200MA |
| 350[lx] | 400[cd] | OFF | 90MA |
| | | ON | 180MA |
| 300[lx] | 350[cd] | OFF | 80MA |
| | | ON | 160MA |

LIQUID CRYSTAL DISPLAY DEVICE AND TV RECEIVER

TECHNICAL FIELD

The present invention relates to a liquid crystal display device having a backlight device capable of controllably illuminating a back surface of a liquid crystal panel for each of areas by a plurality of light sources and a TV receiver equipped with the liquid crystal display device and, more particularly, to a liquid crystal display device executing an intermittent lighting process for continuous light-on and continuous light-off of each of the light sources at a certain ratio in one frame period and a TV receiver equipped with the liquid crystal display device.

BACKGROUND OF THE INVENTION

A liquid crystal display device such as a liquid crystal TV receiver or a liquid crystal monitoring device is equipped with a backlight device that illuminates a liquid crystal panel from behind. This backlight device has a plurality of light sources arranged on the liquid crystal panel in the vertical direction and horizontal direction. Cold-cathode tubes or LEDs are used as the light sources.

It has hitherto been proposed for the liquid crystal display device to help the user easily view a display video of the liquid crystal display device by heightening the luminous intensity of the backlight device when the peripheral illuminance (ambient illuminance) is high but by lowering the luminous intensity of the backlight device when the peripheral illuminance is low (see e.g., Patent Documents 1 and 2). Specifically, the display luminance of the video is regulated by changing the luminous intensity of the backlight device through the change of the lighting time in the PWM control or the intermittent lighting control of the light sources of the backlight device.

Recently, as disclosed in Patent Document 2, the liquid crystal display device may execute an intermittent lighting process of each of the light sources that consists of a predetermined continuous light-on period and a predetermined continuous light-off period in one frame period. This secures a predetermined continuous light-off period (black insertion time) in one frame period to implement a pseudo impulse drive, thereby preventing motion blur in the display video as compared with a hold drive process in which the light sources remain on at all times. Furthermore, through the execution of a backlight scanning process of executing in sequence the intermittent lighting process of each of the light sources in conjunction with the action of writing an image signal to the liquid crystal panel, the time from writing of the image signal to turning on of the light sources can be evened over the entire screen, thereby enhancing the effect of improving motion blur in the display video.

PRIOR ART DOCUMENT

Patent Documents

Patent Document 1: Japanese Laid-Open Patent Publication No. 2001-338776

Patent Document 2: Japanese Laid-Open Patent Publication No. 2004-157373

SUMMARY OF THE INVENTION

Problem to be Solved by the Invention

In case of executing the intermittent lighting process, however, the light-on time of the light sources in one frame period becomes short to secure a predetermined continuous light-off period (black insertion time). Hence, to secure the luminous intensity substantially equal to that in the case of executing the hold drive process, the light-on luminance of the light sources needs to be increased. For this reason, the execution of the intermittent lighting process needs an increase in a maximum drive current supplied to the light sources, incurring an overload on the light sources of the backlight device as compared with the case of executing the hold drive process. To prevent this, the maximum drive current value of the entire backlight device needs to be increased, resulting in an increased size and cost.

If, in particular, the intermittent lighting process is executed at all times in the configuration in which the ambient illuminance is linked with the luminous intensity of the backlight device as described above, the increase in the size and cost of the backlight device cannot be avoided when heightening the luminous intensity of the backlight device as the ambient illuminance becomes high.

The present invention was conceived in view of such circumstances and an object thereof is to provide a liquid crystal display device capable of achieving an improvement of motion blur and a prevention of overload on the light sources with a desired balance in a configuration where the luminous intensity of the backlight device is properly changed in conjunction with the ambient illuminance.

Means for Solving the Problem

To solve the above problems, a first technical means of the present invention is a liquid crystal display device having a backlight device capable of controlling illuminating a back surface of a liquid crystal panel for each area by a plurality of light sources, an intermittent lighting control portion executing an intermittent lighting process for allowing a continuous light-on and a continuous light-off of each of the light sources at a predetermined ratio within one frame, and an ambient illuminance detection portion detecting an ambient illuminance of the liquid crystal display device, comprising: a drive current control portion that change a luminous intensity of the backlight device in conjunction with the level of the ambient illuminance by changing a drive current supplied to the light sources depending on an ambient illuminance detected by the ambient illuminance detection portion and on the execution or nonexecution of the intermittent lighting process by the intermittent lighting control portion, and an intermittent lighting switching portion that causes the intermittent lighting control portion to execute the intermittent lighting process if the ambient illuminance detected by the ambient illuminance detection portion is less than a first predetermined illuminance that is previously set, and causes the intermittent lighting control portion to stop the intermittent lighting process if the ambient illuminance is not less than the first predetermined illuminance and is not less than a second predetermined illuminance that is previously set.

A second technical means is the liquid crystal display device of the first technical means, wherein the second predetermined illuminance is an illuminance higher than the first predetermined illuminance, and wherein the intermittent lighting switching portion causes the intermittent lighting control portion to execute the intermittent lighting process on the condition that the ambient illuminance arrives at less than the first predetermined illuminance during the stop of the intermittent lighting process by the intermittent lighting control portion, and causes the intermittent lighting control portion to stop the intermittent lighting process on the condition that the ambient illuminance arrives at the second predetermined illuminance or more during the execution of the intermittent lighting process by the intermittent lighting control portion.

A third technical means is the liquid crystal display device of the first technical means, wherein the intermittent lighting control portion executes a backlight scanning process that executes the intermittent lighting process in sequence for each of the light sources in conjunction with an action of writing an image signal to the liquid crystal panel.

A fourth technical means is the liquid crystal display device of the first technical means, wherein the second predetermined illuminance is an illuminance at which a previously set threshold current coincides with a drive current to be supplied to the light sources to change the luminous intensity of the backlight device in conjunction with the ambient illuminance with the intermittent lighting process being executed by the intermittent lighting control portion.

A fifth technical means is the liquid crystal display device of the fourth technical means, wherein the light sources are a plurality of LEDs, and the threshold current is a rated current of the LED.

A sixth technical means is the liquid crystal display device of the first or the fourth technical means, further comprising: a mode switching portion that switches an action mode of the liquid crystal display device to a plurality of action modes having different power consumption; and a predetermined illuminance changing portion that changes the first predetermined illuminance and/or the second predetermined illuminance depending on the action mode of the liquid crystal display device.

A seventh technical means is the liquid crystal display device of the first or the fourth technical means, wherein the intermittent lighting switching portion keeps the switched state for a previously set predetermined time after switching between execution and nonexecution of the intermittent lighting process.

An eighth technical means is the liquid crystal display device of the first or the fourth technical means, wherein the intermittent lighting switching portion continuously changes respectively a ratio of a period of the continuous light-off to a period of the continuous light-on and a drive current value in the period of the continuous light-on when switching between execution and stop of the intermittent lighting process.

A ninth technical means is the liquid crystal display device of the first or the fourth technical means, wherein the intermittent lighting switching portion continuously changes a drive current value in the period of the continuous light-on and a drive current value in the period of the continuous light-off, respectively with the predetermined ratio unchanged when switching between execution and stop of the intermittent lighting process.

A tenth technical means is a TV receiver comprising the liquid crystal display device of the first technical means.

Effect of the Invention

According to the present invention, the intermittent lighting process (hereinafter, referred to also as "backlight scanning process") is not executed when acquiring the luminous intensity of the backlight device corresponding to the ambient illuminance not less than the second predetermined illuminance, so that by properly setting the second predetermined illuminance, the power consumption of the backlight device can be suppressed in a predetermined range, thereby achieving prevention of overload on the backlight device and prevention of increase in size resulting from the increase in the maximum drive current.

According to the present invention, the backlight scanning process enables the time from write of a video signal to light-on of the light sources to be uniformed over the entire screen of the liquid crystal panel, in other words, for each of lines, so that the light-on is made after the response of the liquid crystal elements becomes stabilized after the write of the video signal, thereby enhancing the effect of improving the motion blur in the display video.

Since the intermittent lighting of the backlight scanning process is suspended the instant that the second predetermined illuminance is reached or exceeded, the effect of improving the motion blur in the display video may be impaired. In case of the liquid crystal display device configured to raise the display luminance when the peripheral illuminance is high, however, the viewer watches more closely the enhanced contrast according as the screen luminance become higher, resulting in a less close watch on the motion blur in the video. Hence, there exist less demerits arising from the suspension of the intermittent lighting at the predetermined illuminance or higher.

When using the LEDs as the light sources of the backlight device, the drive current to the LEDs can be controlled to be in a range not exceeding the rated current of the LEDs even if the luminous intensity of the backlight device becomes high in conjunction with the ambient illuminance.

BRIEF DESCRIPTION OF DRAWINGS

FIG. 4 is a diagram depicting an example of control correspondence information used in the liquid crystal display device according to the embodiment of the present invention.

PREFERRED EMBODIMENT OF THE INVENTION

Referring to the accompanying drawings, an embodiment of the present invention will now be described for the understanding of the present invention. The embodiment below is merely an example embodying the present invention and is not intended to limit the technical scope of the present invention.

Figure 1:
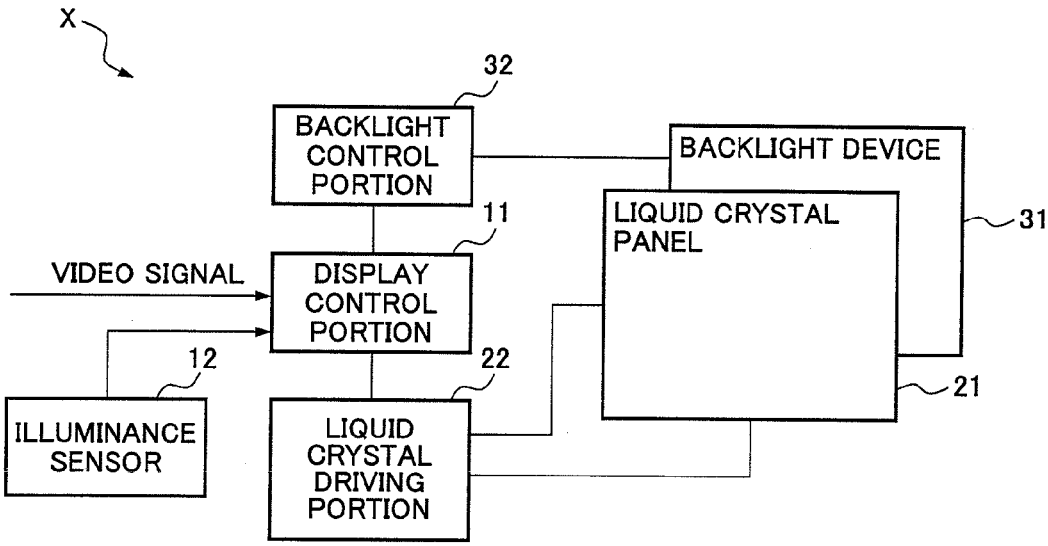
FIG. 1 is a block diagram depicting a schematic configuration of a liquid crystal display device according to an embodiment of the present invention.

FIG. 1 is a block diagram depicting a schematic configuration of a liquid crystal display device according to the embodiment of the present invention. As depicted in the diagram, the liquid crystal display device X according to the embodiment of the present invention includes a display control portion 11, an illuminance sensor 12, a liquid crystal panel 21, a liquid crystal driving portion 22, a backlight device 31, and a backlight control portion 32.

The liquid crystal display device X is e.g. a liquid crystal TV set or a liquid crystal monitoring device. In this embodiment, description will be omitted of other constituent elements not directly affecting the present invention provided with by a common liquid crystal TV set or liquid crystal monitoring device.

The display control portion 11 has control devices such as an MPU, a RAM, and a ROM so that the MPU executes processes in accordance with a predetermined control program stored in the ROM to thereby control actions of the liquid crystal driving portion 22 and the backlight control portion 32.

Specifically, the display control portion 11 receives a video signal contained in television broadcasting received by an antenna (not depicted) or in video content input from an external input terminal (not depicted) and, based on the video signal, generates a vertical synchronizing signal, a horizontal synchronizing signal, etc. The video signal, the vertical synchronizing signal, and the horizontal synchronizing signal are then fed from the display control portion 11 to the liquid crystal driving portion 22. The display control portion 11 feeds the vertical synchronizing signal and the horizontal synchronizing signal to the backlight control portion 32.

At this time, the display control portion 11 generates a vertical synchronizing signal having a drive frequency of 120 Hz that is double the frequency 60 Hz of a video signal in the television broadcasting. Therefore, the display control portion 11 outputs images in one frame of the video signal to the liquid crystal driving portion 22 two times each or generates an interpolation image from two consecutive frames of the video signal to insert it between the two frames for the output to the liquid crystal driving portion 22.

The illuminance sensor 12 is an ambient illuminance detection portion that detects an ambient illuminance (peripheral brightness) of the liquid crystal display device X and inputs the thus detected ambient illuminance to the display control portion 11.

The liquid crystal panel 21 is formed from a liquid crystal layer and a scanning electrode and a data electrode for applying a scan signal and a data signal to the liquid crystal layer and is a conventionally well-known active matrix liquid crystal panel having a plurality of liquid crystal elements whose transmittance varies depending on the applied voltage.

The liquid crystal driving portion 22 drives the scanning electrode (gate electrode) and the data electrode (source electrode) of the liquid crystal panel 21 based on the image signal and the vertical synchronizing signal and horizontal synchronizing signal input from the display control portion 11. Specifically, after the reception of a vertical synchronizing signal, the liquid crystal driving portion 22 outputs a gate signal to the scanning electrode in response to a horizontal synchronizing signal corresponding to a first line and outputs in sequence an image signal corresponding to the first line to the data electrode. This allows a display of images on the first line. Afterward, when receiving a horizontal synchronizing signal corresponding to a second line, the liquid crystal driving portion 22 outputs a gate signal to the scanning electrode on the second line and outputs in sequence an image signal corresponding to the second line to the data electrode. Similar processes are thereafter repeated to display images over the entire screen of the liquid crystal panel 21.

Figure 2:
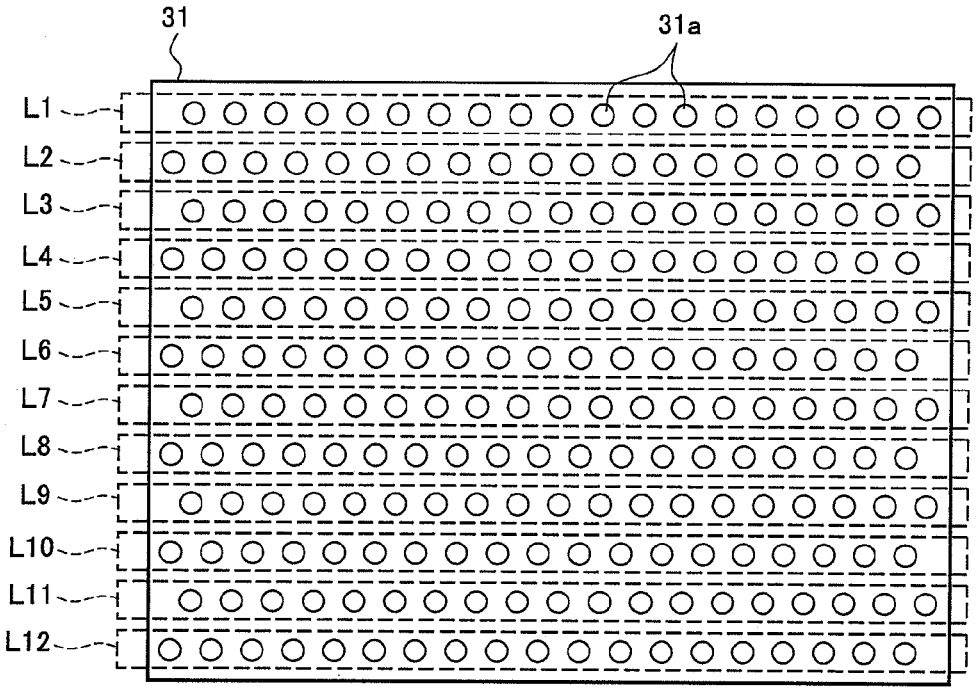
FIG. 2 is an illustrative view of an example of a backlight device disposed in the liquid crystal display device according to the embodiment of the present invention.

The backlight device 31 illuminates the liquid crystal panel 21 from behind by a plurality of LEDs arranged in a matrix manner on the back surface of the liquid crystal panel 21. FIG. 2 is an illustrative view depicting an example of the structure of the backlight device 31.

As depicted in FIG. 2, the backlight device 31 has a plurality of LED groups L1 to L12 (an example of a plurality of light sources) juxtaposed corresponding to a plurality of display areas in the vertical direction of the liquid crystal panel 21. Each of the LED groups L1 to L12 includes a plurality of LEDs 31 juxtaposed in the horizontal direction of the liquid crystal panel 21. Each of the display areas corresponding respectively to the LED groups L1 to L12 is an area including plural lines of display pixels on the liquid crystal panel 21. The configuration may be such that plural lines of cold-cathode tubes are used instead of the LED groups L1 to L12 or that the LED groups L1 to L12 or a plurality of cold-cathode tubes are juxtaposed in the horizontal direction.

The backlight device 31 individually blinks a multiplicity of LEDs 31*a* for each of the LED groups L1 to L12 in response to a control command from the backlight control portion 32. Accordingly, the backlight device 31 is capable of controlling the illumination of the back surface of the liquid crystal panel 21 for each of areas by the multiplicity of LEDs 31*a* (plural light sources). The number of the LED groups L1 to L12 is not limitative and may be properly changed in design depending on the size of the liquid crystal panel 21.

Although the backlight device 31 is exemplarity of a type where it is positioned directly below the liquid crystal panel 21, it may be optionally formed as long as the backlight can be controlled for each area.

For each of the LED groups L1 to L12 of the backlight device 31, the backlight control portion 32 selectively executes either of a hold drive process of lighting all the time at a predetermined frequency and an intermittent lighting process of continuously lighting on and continuously lighting off at a predetermined ratio in one frame period. When executing such an intermittent lighting process, the backlight control portion 32 corresponds to an intermittent lighting control portion.

Specifically, the backlight control portion 32 executes a backlight scanning process of sequentially executing the intermittent lighting process of each of the LED groups L1 and L12 in conjunction with the action of writing an image signal to the liquid crystal panel 21.

As used herein, the one frame period refers to a period for displaying images in one frame on the liquid crystal panel 21, i.e., an interval of the vertical synchronizing signals. Thus, the one frame period is about 8.3 ms in the liquid crystal display device X whose image writing speed (drive frequency) to the liquid crystal panel 21 is 120 Hz (so-called double-speed liquid crystal). Naturally, the drive frequency of the liquid crystal panel may be 60 Hz or 240 Hz.

Figure 3:
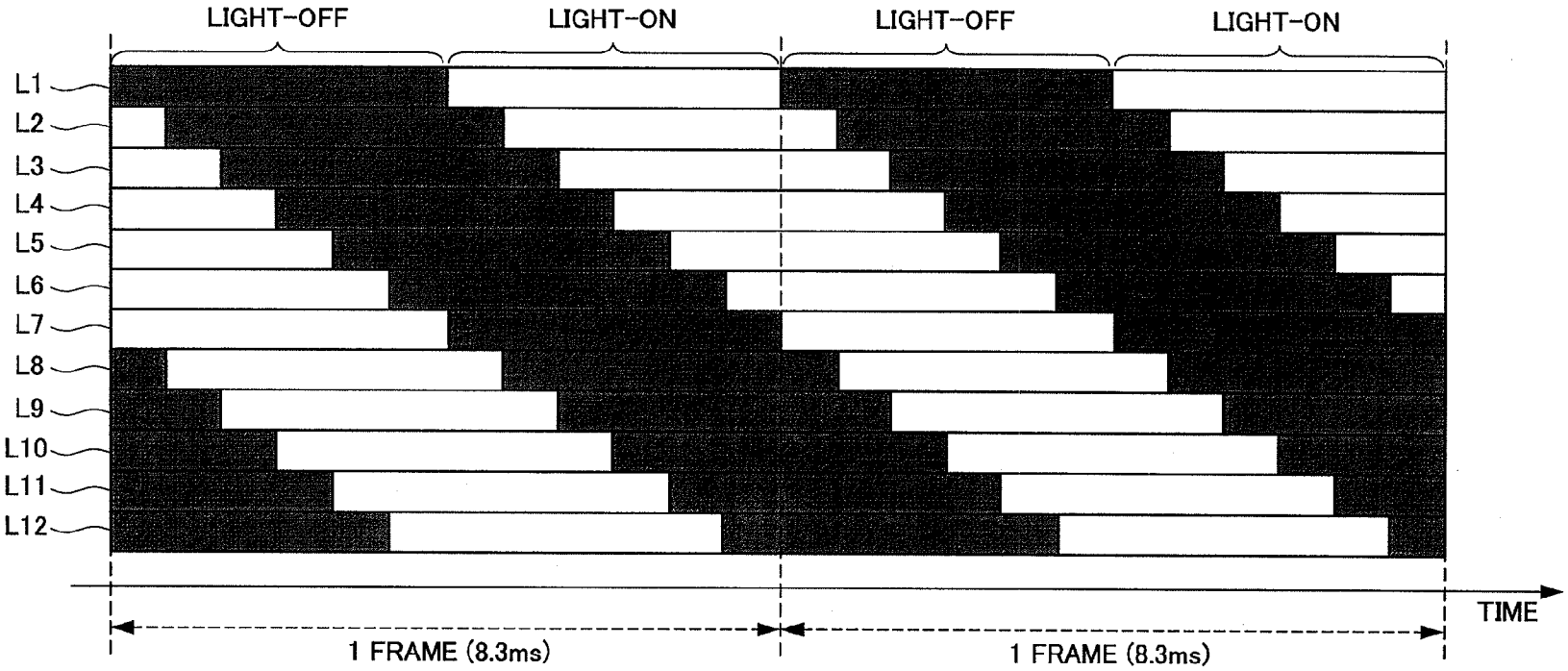
FIG. 3 is an illustrative view for explaining an example of a backlight scanning process for the backlight device of the liquid crystal display device according to the embodiment of the present invention.

FIG. 3 is an illustrative view for explaining an example of the execution result of the backlight scanning process.

When the backlight scanning process is executed by the backlight control portion 32 as depicted in FIG. 3, each of the LED groups L1 to L12 goes off for about 4.1 ms (50% of one frame) from the start of writing of images to the corresponding display area and then goes on for about 4.1 ms (50% of one frame).

Specifically, through the backlight scanning process, the backlight control portion 32 sequentially blinks the LED groups L1 to L12 in synchronism with a vertical synchronizing signal and a horizontal synchronizing signal of an image signal displayed on the display panel 21.

More specifically, in response to the reception of a vertical synchronizing signal, the backlight control portion 32 deactivates the LED group L1 on the first line for about 4.1 ms and thereafter activates it for about 4.1 ms. Then, in response to the reception of a corresponding number of horizontal synchronizing signals to the liquid crystal elements on plural lines of the liquid crystal panel 21 corresponding to the LED group L1, the backlight control portion 32 deactivates the LED group L2 for about 4.1 ms and thereafter activates it for about 4.1 ms. Similarly, in response to the reception of a corresponding number of horizontal synchronizing signals to the liquid crystal elements on plural lines of the liquid crystal panel 21 corresponding to the LED groups L1 and L2, the backlight control portion 32 deactivates the LED group L3 for about 4.1 ms and thereafter activates it for about 4.1 ms. Thereafter, similar processes are repeated so that the LEDs L1 to L12 are blinked in sequence in synchronism with scanning of liquid crystal elements on plural lines of the liquid crystal panel 21 to which the LEDs L1 to L12 correspond respectively.

According to the backlight scanning process executed in this manner, a pseudo impulse drive is implemented so as to be able to prevent motion blur or multiple contours in moving image display. In the example of FIG. 3, the ratio between the continuous light-off (dark) and the continuous light-on (bright) of the LED groups L1 to L12 is such that the light-off time and the light-on time are equally 4.1 ms with the proportion of the continuous light-on time in one frame being 50%. However, this ratio is varied depending on the luminous intensity of the backlight device 31. Description of this embodiment will be made on the assumption that the proportion of continuous light-on time in one frame (hereinafter, referred to also as "light-on ratio") is 50%.

In case the ambient illuminance (peripheral brightness) of the liquid crystal display device X is high that is detected by the illuminance sensor 12 as described above, a display video on the liquid crystal panel 21 can be more clearly viewed by brightening the display video. In case the ambient illuminance of the liquid crystal display device X is low, a display video on the liquid crystal panel 21 can be more clearly viewed by darkening the display video.

Thus, in the liquid crystal display device X, the display control portion 11 executes a backlight control process (see FIG. 5) described later, to change the luminous intensity of the backlight device 31 in conjunction with the ambient illuminance of the liquid crystal display device X. Specifically, the display control portion 11 regulates a drive current fed to the LED groups L1 to L12 such that the luminous intensity of the backlight device 31 becomes high according as the ambient illuminance of the liquid crystal display device X heightens and such that the luminous intensity of the backlight device 31 becomes low according as the ambient illuminance lowers.

Commonly, depending on a user's operation of an operation key disposed on a remote control not depicted or on a main body of the liquid crystal display device X, it is switched by the display control portion 11 whether to execute the backlight scanning process by the backlight control portion 32.

In the backlight scanning process, however, the light-on ratio (the proportion of continuous light-on time in one frame) of the backlight device 31 becomes small to obtain a black insertion effect, so that the current value fed to each of the LED groups L1 to L12 needs to be increased to achieve the same luminous intensity as that in the hold drive process, thus resulting in a need to increase the electric power consumption of the entire backlight device 31. Consequently, when executing the backlight scanning process at all times in the configuration where the luminous intensity of the backlight device 31 is changed in conjunction with the ambient illuminance as described above, the maximum rated drive current value of the entire backlight device 31 has to be increased in case of heightening the luminous intensity of the backlight device 31 depending on the heightened ambient illuminance.

Thus, in the backlight control process (see FIG. 5) described later, the display control portion 11 allows the execution of the backlight scanning process if the ambient illuminance of the liquid crystal display device X is less than a previously set first predetermined illuminance and stops the backlight scanning process if the ambient illuminance is not less than the first predetermined illuminance and is not less than a previously set second predetermined illuminance. In case of executing such a process, the display control portion 11 corresponds to an intermittent lighting switching portion. Description here will be made on the assumption that the first predetermined illuminance and the second predetermined illuminance are set at the same predetermined illuminance.

Figure 5:
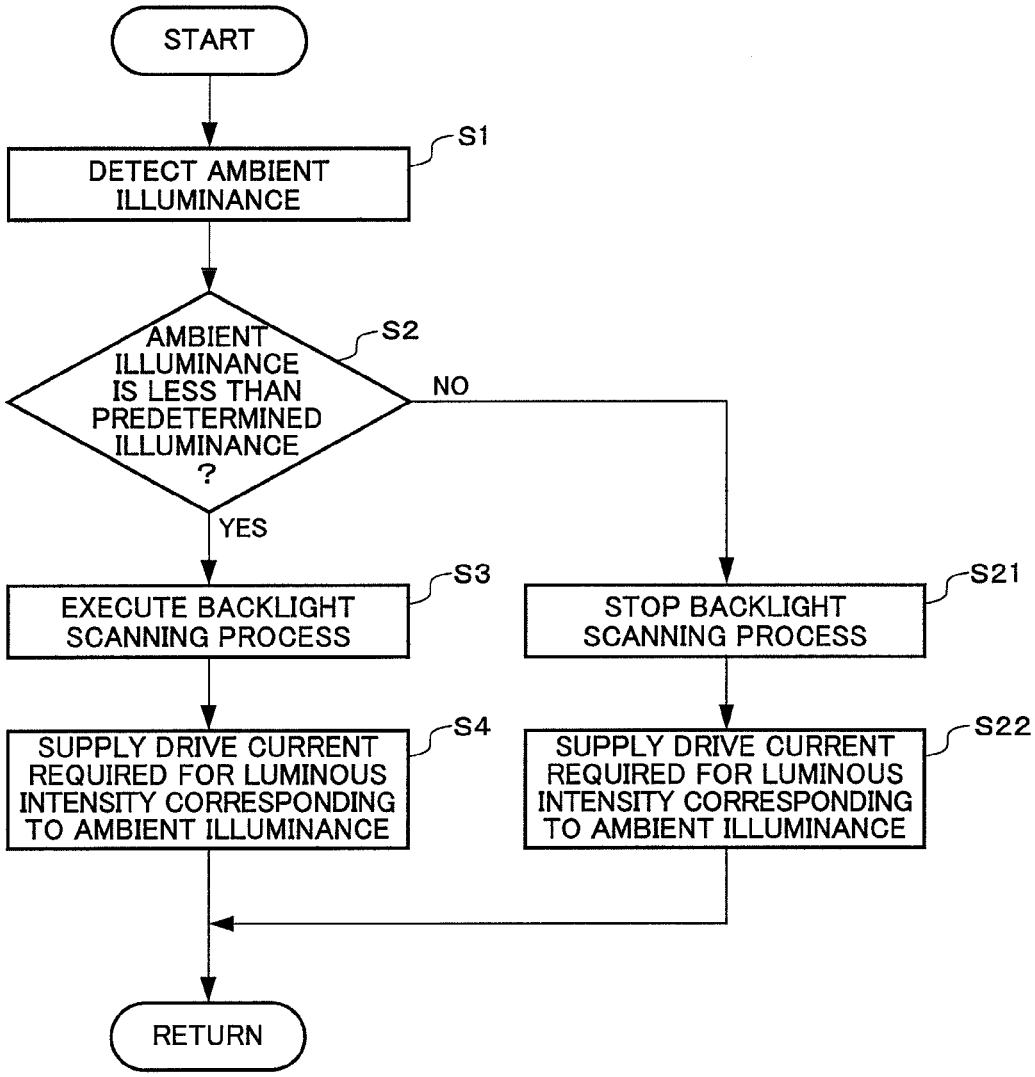
FIG. 5 is flowchart for explaining an example of a procedure of a backlight control process executed in the liquid crystal display device according to the embodiment of the present invention.

With reference to flowchart of FIG. 5, description will be made of an example of a procedure of the backlight control process executed by the display control portion 11. S1, S2, etc. of FIG. 5 refer to process procedure (step) numbers.

In this case, a storage portion such as a ROM disposed in the display control portion 11 stores in advance control correspondence information (see FIG. 4) used as a determination index in the backlight control process executed by the display control portion 11.

FIG. 4 partly depicts the control correspondence information.

The control correspondence information is information, as depicted in FIG. 4, previously setting therein e.g. a proper luminous intensity of the backlight device 31 corresponding to the ambient illuminance of the liquid crystal display device X and a value of a drive current to be supplied to each of the LED groups L1 to S12 of the backlight device 31 to acquire the luminous intensity. Especially, the control correspondence information stores the drive current of the LED groups L1 to L12 required for each of a case (ON) to execute the backlight scanning process and a case (OFF) not to execute when acquiring the luminous intensity of the backlight device 31 corresponding to the ambient illuminance.

Specifically, referring to the control correspondence information of FIG. 4, if the ambient illuminance is 400 [lx], the luminous intensity of the backlight device 31 is desirably 450 [cd]. It can therefore be seen that if the backlight scanning process is OFF, the light-on ratio of 100 [%] and the drive current of 100 [mA] are required and that if the backlight scanning process is ON, the light-on ratio of 50 [%] and the drive current of 200 [mA] are required.

If the ambient illuminance is 350 [lx], the luminous intensity of the backlight device 31 is 400 [cd]. At this time, if the backlight scanning process is OFF, the drive current of 90 [mA] is required, while if the backlight scanning process is ON, the drive current of 180 [mA] is required. Similarly, if the ambient illuminance is 300 [lx], the luminous intensity of the backlight device 31 is 350 [cd]. At this time, if the backlight scanning process is OFF, the drive current of 80 [mA] is required, while if the backlight scanning process is ON, the drive current of 160 [mA] is required. Note that the control correspondence information described here is merely an example and that it may previously set therein e.g. a predetermined relational expression defining these relations.

<Steps S1 and S2>

First, at step S1, the display control portion 11 acquires an ambient illuminance (peripheral brightness) of the liquid crystal display device X by the illuminance sensor 12.

Then, at step S2, the display control portion 11 determines whether the ambient illuminance detected by the illuminance sensor 12 is less than a previously set predetermined illuminance. The predetermined illuminance is an illuminance ensuring a threshold current that is previously set as a drive current to be supplied to the LED groups L1 to L12 for changing the luminous intensity of the backlight device 31 in conjunction with the ambient illuminance in a state where the backlight scanning process is executed by the backlight control portion 32. Specifically, in the example depicted in FIG. 4, if the drive current supplied to the LED groups L1 to L12 of the backlight device 31 is desired to be less than 180 [mA], the predetermined illuminance is set to 350 [lx]. Naturally, the determination index of step S2 may be the drive current value in lieu of the ambient illuminance.

If it is determined that the ambient illuminance is less than the predetermined illuminance (Yes at S2), the process goes to step S3, whereas if the ambient illuminance is determined to be not less than the predetermined illuminance (No at S2), the process goes to step S21.

<Steps S3 and S4>

If the ambient illuminance is less than the predetermined illuminance (Yes at S2), the drive current supplied to the LED groups L1 to L12 becomes less than the threshold current even though the backlight scanning process is executed in the backlight device 31, consequently preventing an excessive increase in the power consumption of the backlight device 31 required for obtaining the luminous intensity of the backlight device 31 corresponding to the ambient illuminance.

Thus, at the subsequent steps S3 and S4, the display control portion 11 causes the backlight control portion 32 to execute a backlight scanning process of the backlight device 31 (S3) and controls the drive current supplied to each of the LED groups L1 to L12 so that the luminous intensity of the backlight device 31 obtained by the backlight scanning process coincides with the luminous intensity corresponding to the ambient illuminance (S4).

For example, as depicted in FIG. 4, when the ambient illuminance is 300 [lx], a proper luminous intensity of the backlight device 31 is 350 [cd] and a drive current is 160 [mA] that is required for achieving the luminous intensity with the backlight scanning process being executed, whereupon the display control portion 11 causes the backlight control portion 32 to supply the current of 160 [mA] to the LED groups L1 to L12.

In this manner, the display control portion 11 corresponds to a drive current control portion of the present invention and changes the drive current supplied to the LED groups L1 to L12 depending on the ambient illuminance and on the execution of the backlight scanning process, to thereby change the luminous intensity of the backlight device 31 in conjunction with the level of the ambient illuminance.

Although in this embodiment, the display control portion 11 changes the drive current supplied to the LED groups L1 to L12 when executing the backlight scanning process to consequently change the luminous intensity of the backlight device 31 in conjunction with the level of the ambient illuminance, the drive current supplied to the LED groups L1 to L12 may be subjected to a PWM control to change the luminous intensity of the backlight device 31 in conjunction with level of the ambient illuminance.

<Steps S21 and S22>

On the contrary, when the ambient illuminance is not less than the predetermined illuminance (No at S2), the drive current supplied to the LED groups L1 to L12 becomes not less than the threshold current in order to achieve the luminous intensity of the backlight device 31 corresponding to the ambient illuminance with the backlight scanning process being executed in the backlight device 31, resulting in the risk that the current of the backlight device 31 may excessively increase.

Thus, at the subsequent steps S21 and S22, the display control portion 11 causes the backlight control portion 32 to stop the backlight scanning process of the backlight device 31 to execute the hold drive process (S21) and controls the drive current supplied to each of the LED groups L1 to L12 so that the luminous intensity of the backlight device 31 obtained by the hold drive process coincides with the luminous intensity corresponding to the ambient illuminance (S22).

For example, as depicted in FIG. 4, when the ambient illuminance is 400 [lx], a proper luminous intensity of the backlight device 31 is 450 [cd] and a drive current is 100 [mA] that is required for achieving the luminous intensity with the backlight scanning process not being executed but with the hold drive process being executed, whereupon the display control portion 11 causes the backlight control portion 32 to supply the current of 100 [mA] to the LED groups L1 to L12.

Incidentally, even if the ambient illuminance is not less than 400 [lx] and the proper luminous intensity of the backlight device 31 is not less than 450 [cd] in the state of the hold drive process, the LED groups L1 to L12 can be supplied with a current up to 180 mA that is a threshold current.

In this manner, the display control portion 11 corresponds to the drive current control portion of the present invention and changes the drive current supplied to the LED groups L1 to L12 depending on the ambient illuminance and on the nonexecution of the backlight scanning process, to thereby change the luminous intensity of the backlight device 31 in conjunction with the level of the ambient illuminance.

In the liquid crystal display device X, as described above, the backlight control process is executed by the display control portion 11 so that the backlight scanning process is not executed when achieving the luminous intensity of the backlight device 31 corresponding to the ambient illuminance not less than a predetermined illuminance, with the result that the light-one maximum current of the backlight device 31 can be suppressed within a predetermined range by properly setting the predetermined illuminance, thereby enabling the improvement in motion blur and the prevention of overload on the light sources to be achieved with a desired balance.

Specifically, by previously setting as a predetermined illuminance the ambient illuminance of 350 [lx] at which the drive current of 180 [mA] is supplied to the LED groups L1 to L12 with the backlight scanning process being executed, if the ambient illuminance is less than 350 [lx], the backlight scanning process is executed to prevent the motion blur, whereas if the ambient illuminance is not less than 350 [lx], the backlight scanning process is stopped to execute the hold drive process to restrain the current from increasing up to a value more than or equal to the light-on threshold.

Although in this embodiment, description has been made of the case by way of example where the predetermined illuminance is set for suppressing the current value of the backlight device 31 within a predetermined range, the predetermined illuminance may be set using a rated current of an LED 31*a* for example as the threshold current so as not to be supplied with a current more than or equal to the rated current. This enables the backlight scanning process to be executed in a range less than the rated current of the LED 31*a*, thus preventing the damage of the LED 31*a*.

By the way, in the liquid crystal display device X, a main control portion not depicted for example may switch the action mode of the liquid crystal display device X to a plurality of action modes each having different brightness in the display video and different power consumption amount, in response to a user's operation of the remote control, etc. When executing such a process, the main control portion etc., corresponds to a mode switching portion. For example, the modes are a dynamic mode, a standard mode, a cinema mode, etc., in the descending order of the brightness of the display video on the liquid crystal panel 21 and of the power consumption.

Thus, the display control portion 11 may change the predetermined illuminance defined as a first predetermined illuminance or a second predetermined illuminance depending on the action mode of the liquid crystal display device X. When executing such a change process, the display control portion 11 corresponds to a predetermined illuminance changing portion.

For example, if the action mode of the liquid crystal display device X is the dynamic mode, the predetermined illuminance may be set to 400 [lx]; if it is the standard mode, the predetermined illuminance may be set to 350 [lx]; and if it is the cinema mode, the predetermined illuminance may be set to 300 [lx].

As a result of this, the determination index of whether to execute the backlight scanning process is changed for each of the action modes of the liquid crystal display device X, whereby the drive current of the backlight device 31 can be suppressed in a predetermined range that depends on each of the action modes.

If it is often switched whether to execute the backlight scanning process in a case where the ambient illuminance often changes around the predetermined illuminance in the backlight control process, the display video may be affected at the switching, imparting the user an uncomfortable feeling.

It is thus conceivable as a second embodiment that after switching of whether to execute the backlight scanning process (intermittent lighting process) in the backlight control process, the display control portion 11 keeps the switched state during a previously set predetermined time.

It may be switched whether to execute the backlight scanning process on condition of continuation over a predetermined time or more of the state where the ambient illuminance is less than the predetermined illuminance or of the state where it is not less than the predetermined illuminance. This enables whether to execute the backlight scanning process to be switched at least at the predetermined time interval, preventing the user from experiencing an uncomfortable feeling due to frequent switching.

Although in the above embodiment, description has been made of the case by way of example where the first predetermined illuminance and the second predetermined illuminance are the same predetermined illuminance, the second predetermined illuminance may be set to a higher illuminance than the first predetermined illuminance if it is not less than the first predetermined illuminance. In the case where the second predetermined illuminance is set to a higher illuminance than the first predetermined illuminance, the display control portion 11 may execute a backlight scanning process on condition of arrival at less than the first predetermined illuminance during the stop of the backlight scanning process (intermittent lighting process), while the display control portion 11 may stop a backlight scanning process on condition of arrival at not less than the second predetermined illuminance during the execution of the backlight scanning process. This imparts a hysteresis characteristic to switching of the backlight scanning process and such a configuration is also capable of preventing the user from experiencing an uncomfortable feeling arising from the frequent switching between the execution and nonexecution of the backlight scanning process.

In order to prevent the user from experiencing an uncomfortable feeling arising from the frequent switching of whether to execute the backlight scanning process (intermittent lighting process), these methods may be combined.

Sudden switching between the stop and execution of the backlight scanning process causes a sharp change in the amount of motion blur and a sharp change in the flickering on the screen, a predetermined time may be secured for the switching between the execution and stop.

One method may be a method of transitioning while gradually changing the light-on ratio and by gradually changing the drive current value.

Figure 6:
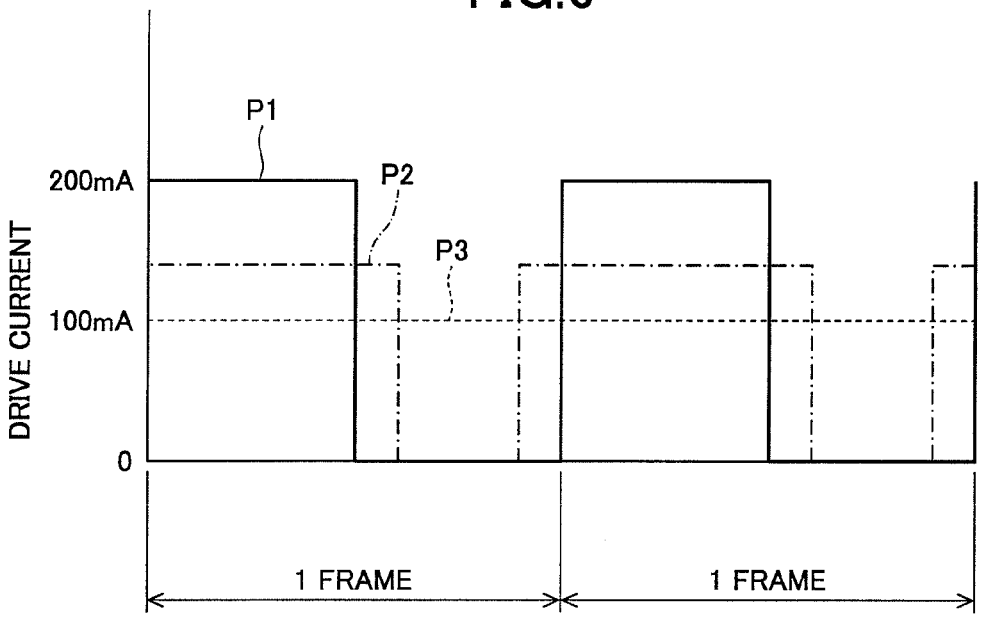
FIG. 6 is a diagram for explaining an example of a process at execution and stop of the backlight scanning process in the liquid crystal display device according to the embodiment of the present invention.

FIG. 6 is a diagram for explaining an example of a process at execution and stop of the backlight scanning process in the liquid crystal display device according to the embodiment of the present invention, the diagram representing the case of the LED group L7 depicted in FIG. 3.

For example, in case of the backlight scan ON at the backlight luminous intensity of 450 cd of FIG. 4, the drive current is 200 mA at the light-on ratio 50% (the state of continuous light-on of 50% per frame), with the LED group L7 being driven by a drive current indicated by a solid-line waveform P1 of FIG. 6. In case of the backlight scan OFF, each of the LED groups is fed with a drive current of 100 mA at the light-on ratio 100%, with the LED group L7 being driven by a drive current indicated by a dotted-line waveform P3 of FIG. 6.

Thus, in case of the backlight scan switching from ON to OFF, the light-on ratio is gradually continuously increased from 50% to 100%, while simultaneously the drive current is gradually continuously reduced from 200 mA to 100 mA. At this time, the total luminous intensity is controlled to be unchanged. For example, as indicated by a dashed-dotted-line waveform P2 of FIG. 6, the current in the light-on period is set to 140 mA with the light-on ratio 70% and then the current value is gradually reduced to 100 mA with the light-on ratio gradually increased to 100%. In case of the backlight scan switching from OFF to ON, reverse actions to the above are carried out. These actions are carried out by the backlight control portion 32 corresponding to an intermittent lighting control portion of the present invention.

In this case, the switching change time is preferably of the order of 5 sec. or more. Such actions eliminate a sharp increase of blur and a sharp change of flickering, to achieve a relief from an uncomfortable feeling and a prevention of degradation in the video quality.

Conceivable as another method is a method in which the backlight light-off period is gradually turned on into a final full light-on state.

Figure 7:
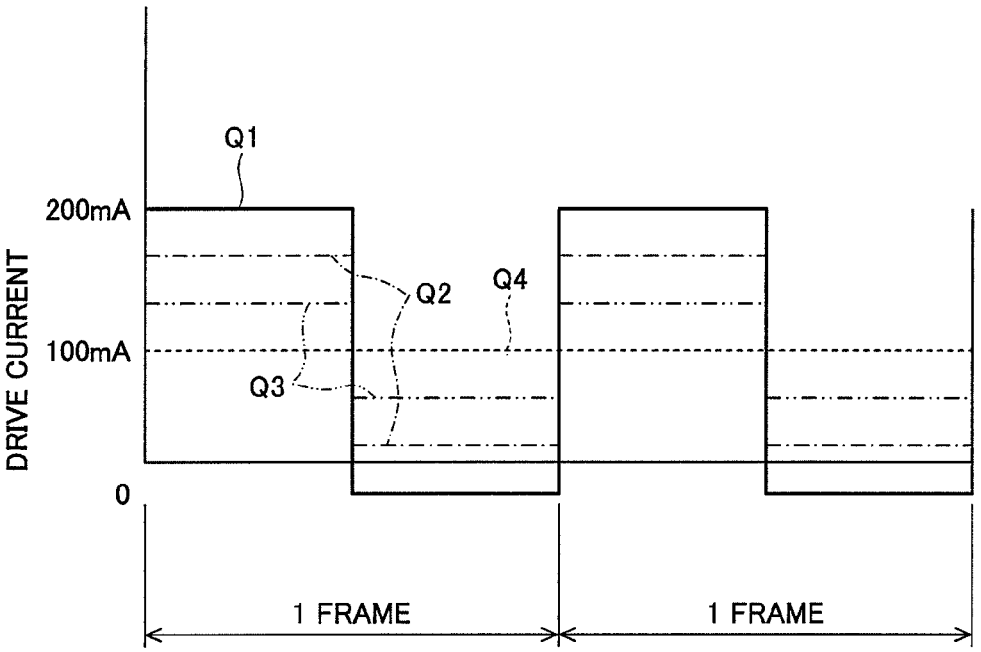
FIG. 7 is a diagram for explaining another example of the process at execution and stop of the backlight scanning process in the liquid crystal display device according to the embodiment of the present invention.

FIG. 7 is a diagram for explaining another example of the process at execution and stop of the backlight scanning process in the liquid crystal display device according to the embodiment of the present invention, the diagram representing the case of the LED group L7 depicted in FIG. 3.

For example, in case of the backlight scan ON at the backlight luminous intensity of 450 cd of FIG. 4, the drive current is 200 mA at the light-on ratio 50%, with the LED group L7 being driven by a drive current indicated by a solid line Q1 of FIG. 7. In case of the backlight scan OFF, each of the LED groups is fed with a drive current of 100 mA at the light-on ratio 100%, with the LED group L7 being driven by a drive current indicated by a dotted line Q4 of FIG. 7.

Thus, in case of the backlight scan switching from ON to OFF, the backlight light-off period is turned on at the unchanged light-on ratio 50% to gradually continuously increase the luminance to obtain the current value 100 mA at the hold drive. The current in the backlight light-on period is gradually continuously reduced to obtain the current value 100 mA at the hold drive. At this time, the total luminous intensity is controlled to be unchanged. For example, as indicated by a dashed dotted line Q2 of FIG. 7, the light-off period is turned on with a current of 30 mA to obtain a current of 170 mA in the light-on period. Furthermore, as indicated by a dashed double-dotted line Q3 of FIG. 7, the light-off period is turned on with a current of 65 mA to obtain a current of 135 mA in the light-on period and finally achieve a current of 100 mA in all the periods.

By performing such switching based on the continuous change in the drive current, the backlight scan can be switched on and off without any uncomfortable feeling. The change time is preferably of the order of 5 sec. or more, of which effect is similar to that of the case depicted in FIG. 6. In case of the backlight scan switching from OFF to ON, reverse actions to the above are carried out. These actions are carried out by the backlight control portion 32 corresponding to the intermittent lighting control portion of the present invention.

INDUSTRIAL APPLICABILITY

The present invention is applicable to a liquid crystal display device such as a liquid crystal TV receiver o a liquid crystal monitoring device.

EXPLANATION OF REFERENCE NUMERALS

11 . . . display control portion, 12 . . . illuminance sensor (one example of ambient illuminance detection portion), 21 . . . liquid crystal panel, 22 . . . liquid crystal driving portion, 31 . . . backlight device, 31*a* . . . LED, 32 . . . backlight control portion, L1-L12 . . . LED group (one example of a plurality of light sources), and X . . . liquid crystal display device.

The invention claimed is:

1. A liquid crystal display device having a backlight device controlling illuminating a back surface of a liquid crystal panel for each area by a plurality of light sources, an intermittent lighting control portion executing an intermittent lighting process for allowing a continuous light-on and a continuous light-off of each of the light sources at a predetermined ratio within one video frame period, and an ambient illuminance detection portion detecting an ambient illuminance of the liquid crystal display device, comprising:

a drive current control portion that changes a luminous intensity of the backlight device in conjunction with the level of the ambient illuminance by changing a drive current supplied to the light sources depending on an ambient illuminance detected by the ambient illuminance detection portion and on the execution or nonexecution of the intermittent lighting process by the intermittent lighting control portion, and an intermittent lighting switching portion that causes the intermittent lighting control portion to execute the intermittent lighting process if the ambient illuminance detected by the ambient illuminance detection portion is less than a first predetermined illuminance that is previously set, and causes the intermittent lighting control portion to stop the intermittent lighting process for allowing continuous light-on of each of the light sources if the ambient illuminance is not less than the first predetermined illuminance and is not less than a second predetermined illuminance that is previously set.

2. The liquid crystal display device as defined in claim 1, wherein the second predetermined illuminance is an illuminance higher than the first predetermined illuminance, and wherein the intermittent lighting switching portion causes the intermittent lighting control portion to execute the intermittent lighting process on the condition that the ambient illuminance arrives at less than the first predetermined illuminance during the stop of the intermittent lighting process by the intermittent lighting control portion, and causes the intermittent lighting control portion to stop the intermittent lighting process on the condition that the ambient illuminance arrives at the second predetermined illuminance or more during the execution of the intermittent lighting process by the intermittent lighting control portion.

3. The liquid crystal display device as defined in claim 1, wherein the intermittent lighting control portion executes a backlight scanning process that executes the intermittent lighting process in sequence for each of the light sources in conjunction with an action of writing an image signal to the liquid crystal panel.

4. The liquid crystal display device as defined in claim 1, wherein the second predetermined illuminance is an illuminance at which a previously set threshold current coincides with a drive current to be supplied to the light sources to change the luminous intensity of the backlight device in conjunction with the ambient illuminance with the intermittent lighting process being executed by the intermittent lighting control portion.

5. The liquid crystal display device as defined in claim 4, wherein the light sources are a plurality of LEDs, and the threshold current is a rated current of the LED.

6. The liquid crystal display device as defined in claim 1, further comprising: a mode switching portion that switches an action mode of the liquid crystal display device to a plurality of action modes having different power consumption; and a predetermined illuminance changing portion that changes the first predetermined illuminance and/or the second predetermined illuminance depending on the action mode of the liquid crystal display device.

7. A TV receiver comprising the liquid crystal display device as defined in claim 1.

8. A method of controlling a backlight device illuminating a back surface of a liquid crystal panel for each area by a plurality of light sources capable of executing an intermittent lighting process for allowing a continuous light-on and a continuous light-off of each of the light sources at a predetermined ratio within one video frame period, the method comprising:

detecting an ambient illuminance of the liquid crystal display device;

changing a luminous intensity of the backlight device in conjunction with the level of the ambient illuminance by changing a drive current supplied to the light sources depending on the detected ambient illuminance and on the execution or nonexecution of the intermittent lighting process;

executing the intermittent lighting process if the detected ambient illuminance is less than a first predetermined illuminance that is previously set, and stopping the intermittent lighting process for allowing continuous light-on of each of the light sources if the ambient illuminance is not less than the first predetermined illuminance and is not less than a second predetermined illuminance that is previously set.

9. The method as defined in claim 8, wherein the second predetermined illuminance is an illuminance higher than the first predetermined illuminance, the method further comprising:

executing the intermittent lighting process on the condition that the ambient illuminance arrives at less than the first predetermined illuminance during the stoppage of the intermittent lighting process, and stopping the intermittent lighting process on the condition that the ambient illuminance arrives at the second predetermined illuminance or more during the execution of the intermittent lighting process.

10. The method as defined in claim 8, executing a backlight scanning process that executes the intermittent lighting process in sequence for each of the light sources in conjunction with an action of writing an image signal to the liquid crystal panel.

11. The method as defined in claim 8, wherein the second predetermined illuminance is an illuminance at which a previously set threshold current coincides with a drive current to be supplied to the light sources to change the luminous intensity of the backlight device in conjunction with the ambient illuminance with the intermittent lighting process being executed.

12. The method as defined in claim 11, wherein the light sources are a plurality of LEDs, and the threshold current is a rated current of the LED.

13. The method as defined in claim 11, further comprising: switching an action mode of the liquid crystal display device to a plurality of action modes having different power consumption; and changing the first predetermined illuminance and/or the second predetermined illuminance depending on the action mode of the liquid crystal display device.

14. The method as defined in claim 11, keeping a switched state for a previously set predetermined time after switching between execution and nonexecution of the intermittent lighting process.

15. The method as defined in claim 11, further comprising:

continuously changing respectively a ratio of a period of the continuous light-off to a period of the continuous light-on and a drive current value in the period of the continuous light-on when switching between execution and stoppage of the intermittent lighting process.

16. The method as defined in claim 11, further comprising:

continuously changing a drive current value in the period of the continuous light-on and a drive current value in the period of the continuous light-off, respectively with the predetermined ratio unchanged when switching between execution and stoppage of the intermittent lighting process.

17. The method as defined in claim 8, further comprising: switching an action mode of the liquid crystal display device to a plurality of action modes having different power consumption; and changing the first predetermined illuminance and/or the second predetermined illuminance depending on the action mode of the liquid crystal display device.

18. The method as defined in claim 8, further comprising: keeping a switched state for a previously set predetermined time after switching between execution and nonexecution of the intermittent lighting process.

19. The method as defined in claim 8, further comprising:

continuously changing respectively a ratio of a period of the continuous light-off to a period of the continuous light-on and a drive current value in the period of the continuous light-on when switching between execution and stoppage of the intermittent lighting process.

20. The method as defined in claim 8, further comprising:

continuously changing a drive current value in the period of the continuous light-on and a drive current value in the period of the continuous light-off, respectively with the predetermined ratio unchanged when switching between execution and stop of the intermittent lighting process.

* * * * *